United States Patent [19]

Weglin

[11] 4,438,569

[45] Mar. 27, 1984

[54] DRAFTING MACHINE

[75] Inventor: Walter Weglin, Bellevue, Wash.

[73] Assignee: Robert J. Gillespie, Seattle, Wash.

[21] Appl. No.: 428,726

[22] Filed: Sep. 30, 1982

[51] Int. Cl.[3] ..... B43L 13/00

[52] U.S. Cl. ..... 33/438; 33/1 M; 33/433

[58] Field of Search ..... 33/438, 1 AA, 403, 427, 33/429, 430, 433, 434, 464, 465, 474, 1 M

[56] References Cited

U.S. PATENT DOCUMENTS

| | | | |
|---|---|---|---|
| 1,436,673 | 11/1922 | Nunamaker | 33/438 |
| 2,243,838 | 6/1941 | Cunningham | 33/433 |
| 3,431,651 | 3/1969 | Graham | 33/434 |
| 3,950,853 | 4/1976 | Andrew | 33/1 M |
| 4,087,916 | 5/1978 | Goguillot | 33/438 |

FOREIGN PATENT DOCUMENTS

| | | | |
|---|---|---|---|
| 1018001 | 12/1952 | France | 33/438 |

*Primary Examiner*—Willis Little

*Attorney, Agent, or Firm*—Seed and Berry

[57] ABSTRACT

A drafting machine includes a pair of perpendicular straight edges slidably mounted with respect to reference scales integrally mounted within the drafting machine. A fine adjustment mechanism includes a worm and spur gear combination for moving the straight edges with respect to the scales. An override mechanism allows the straight edges to move freely with respect to the scales. The drafting machine preferably includes a second adjustable scales adjacent each reference scales for ease and accuracy in measuring.

26 Claims, 13 Drawing Figures

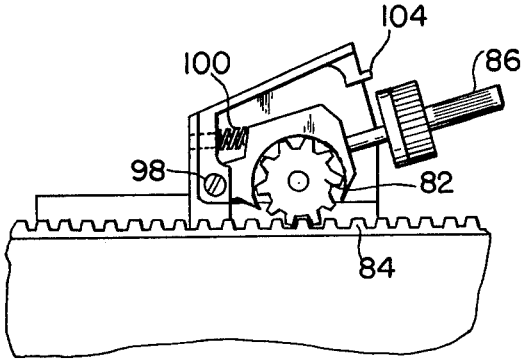
FIG. 9
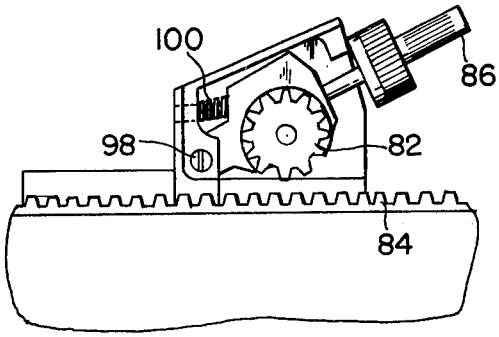
FIG. 10
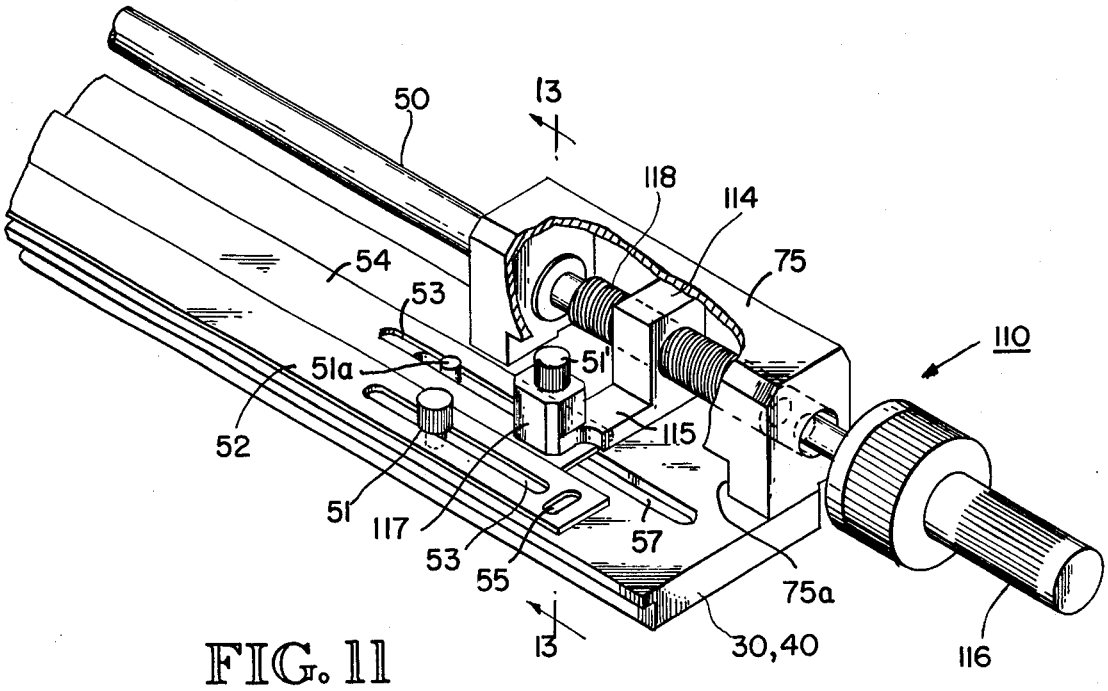
FIG. 11
FIG. 12
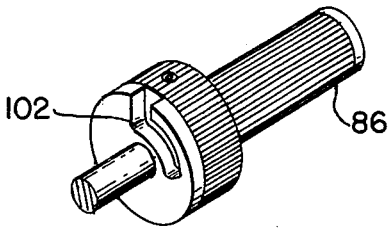
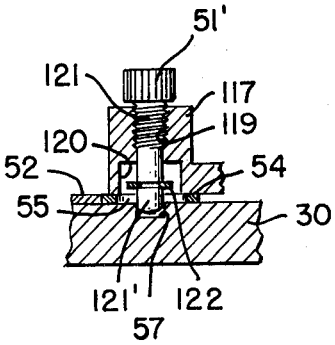
FIG. 13

DRAFTING MACHINE

DESCRIPTION

1. Technical Field

This invention relates to drafting equipment, and more particularly, to a drafting machine having removable scales integral therewith and straight edges finely adjustable with respect to the scales.

2. Background Art

Architectural or engineering plans are normally prepared on paper secured to a drafting table. A drafting table comprises a relatively large, flat, smooth drawing surface which can be inclined to suit the preferance of the individual draftsperson. Although drafting tables are usually inclined at some angle between vertical and horizontal when in use, directions will be referred to herein as if the tables were positioned vertically.

Preparing architectural or engineering drawings often requires that objects be located with respect to a vertical and horizontal axis and drawn with as much speed and accuracy as possible. Measuring instruments known as "scales" are used to position dots to accurately mark off distances along a horizontal or vertical axis. Once distances are marked off with dots using a scale, straight lines are drawn through the dot marks with the aid of a straight edge.

Drafting machines are devices which are attached to a drafting table to aid a draftsperson in preparing an architectural or engineering drawing. They combine the functions of a parallel ruler, protractor, scale and triangle. A conventional drafting machine includes a pair of straight edges mounted perpendicularly to one another. These straight edges lie flat against the drafting table and are rotatably mounted on a protractor head. A movable arm assembly is mounted on the table to support the protractor head. The majority of drafting machines are constructed so that the protractor head may be moved over the surface of the table without change in orientation by using one of two types of movable arm assemblies. The first type is not lockable and utilizes a parallel motion linkage comprising two sets of double bars with an intermediate elbow joint. The second type, which is lockable, utilizes a vertical arm which spans the height of the table and is slidably mounted on the top of the table for horizontal movement with a locking means. Relatively short horizontal and vertical straight edge scales are attached to a protractor head which is slidably attached to the vertical arm with locking means. By using the movable arm assembly to move the protractor head around the board and rotating the protractor head and positioning it in accordance with angular indicia marked thereon, the draftsperson can position the straight edges at desired angles with respect to the vertical and horizontal at most locations on the table.

When preparing drawings with a conventional drafting machine, a several-step process is required to locate and draw objects. Initially, horizontal and vertical reference lines are made with light pencil. A scale is then placed adjacent the reference line and dots are placed on the reference line to mark off coordinates corresponding to dimensions on the object being drawn. Once coordinates have been marked off on the reference lines, the straight edges of the drafting machine can be used to draw lines through these points on the drawing. These points may correspond, for example, to the center of a circle, the terminus of an arc, the intersection of two lines, or the end points of a line parallel to the reference lines. Scales may again be used to mark off points on such parallel lines.

Although the process described above allows a draftsperson to complete a drawing more quickly and accurately than without the aid of a conventional drafting machine, several undesirable aspects remain with such a procedure. Marking off points with a scale is a relatively slow process which is susceptible to inaccuracies. When marking off the coordinates on reference lines, for example, dots may not be accurately placed. When the straight edges are placed adjacent such dots in order to draw lines through the dots on the drawing, an additional error may occur. Additional inaccuracies may be introduced by improper reading of the scale. When marking fractional or decimal dimensions (e.g., 12 53/64 or 12.828 inches), it is often necessary to read closely spaced gradations, and errors may occur. Additionally, because the smallest gradations on architectural scales are marked only on one end of the scale rather than along its entire length, marking off two successive fractional dimensions can be either time-consuming or inaccurate. For example, to mark off a 1-foot, 5-inch line starting 1 foot-2 ½ inches from a given point using a conventional scale, it is necessary either to add the two dimensions together (consuming extra time) or measure the second distance (i.e., 1 foot 5 inches) from the first distance, a procedure which will result in compounding any error which may occur in the first measurement.

DISCLOSURE OF INVENTION

It is an object of this invention is to provide a drafting machine which will allow a draftsperson to accurately and quickly locate and mark points on an engineering or architectural drawing.

Another object of the invention is to provide a drafting machine which allows the drawing of precisely located lines without the necessity of using locating dots or marks on the drawing.

A further object of this invention to provide a drafting machine which will allow objects to be precisely and quickly located and drawn without the aid of separate scales.

Still another object of the invention to provide a drafting machine which will permit easy and accurate measurement of fractional or decimal distances.

A further object is to provide a drafting machine with a fine adjustment-locking means for both horizontal and vertical straight edges without necessitating the movement of the heavier transport elements of the drafting system; i.e., the parallel motion linkage elbow joint arms or vertical arm.

It is another object of this invention to provide a drafting machine which will allow accurate measurement of distances along an angle.

An additional object is to provide a drafting machine which can readily be used for plotting graphs.

A further object is to provide a drafting machine having readily interchangeable scales integral therewith which can be easily read by a user of the drafting machine.

Another object is to provide a drafting machine with a fine adjustment-locking means for both horizontal and vertical straight edges including measuring scales so located as to be readily readable in the immediate drawing area.

These and other objects, which will become more apparent as the invention is more fully described below, are obtained by providing a drafting machine having a straight edge assembly including a pair of straight edges mounted perpendicularly to one another. Each straight edge is slidable and alignable with respect to a scale which is integral with the drafting machine to permit the user to draw lines at measured distances without first marking off the distances with a separate scale. The slidable straight edges abut one another closely enough to permit the drawing of a small continuous right-angle mark to locate alignment points precisely on a drawing or graph.

Each straight edge is connected to a slidable housing which is movable along a guide rod on a mounting bar on which at least one scale is removably mounted. A viewing window, preferably equipped with a magnifying lens, is positioned within the housing to allow viewing of the scales through the slidable housing. Fine adjustment assemblies within the slidable housings allow incremental movement of the straight edges with respect to the measuring scales. A worm gear and spur gear combination within each fine adjustment assembly locks the assembly to a rack and also moves the assembly along the rack located on the side of each mounting bar in response to rotation of an adjustment knob. An override mechanism can be activated to isolate the gear combination from the rack and allow the slidable housing to slide freely along the guide rods and measuring scales. The surfaces of the slidable housing, which slide along the mounting bar to prevent rotation of the slidable housing during movement, are preferably coated with synthetic fluorene-containing resin material, such as Teflon or other similar materials, for reduced friction sliding.

An adjustable scale and a reference scale are preferably removably mounted on each mounting bar. An adjustment mechanism allows the adjustable scales to move with respect to the reference scales, thereby allowing the user to position a starting point for a measurement at an integer reading on the adjustable scales. A point located a fractional distance away from such starting point may then be easily located by simply moving the slidable housing and straight edge into alignment with a point on the scales which is the sum of the integer and the fractional distance desired. The scales are preferably formed of metallic material so that magnets positioned within the mounting bars can hold the scales securely against the mounting bars.

BRIEF DESCRIPTION OF THE DRAWINGS

FIG. 9 is a bottom plan view (cover removed) of the fine adjustment assembly shown with the spur gear engaging the rack;

FIG. 10 is a bottom plan view (cover removed) of the fine adjustment assembly with the override mechanism activated;

FIG. 11 is an isometric view of the scale adjustment assembly cut away to show the traveling nut;

FIG. 12 is an isometric view of the adjustment knob of the fine adjustment assembly; and FIG. 13 is a detail sectional view taken on line 13—13 of FIG. 11.

BEST MODE FOR CARRYING OUT THE INVENTION

Figure 1:
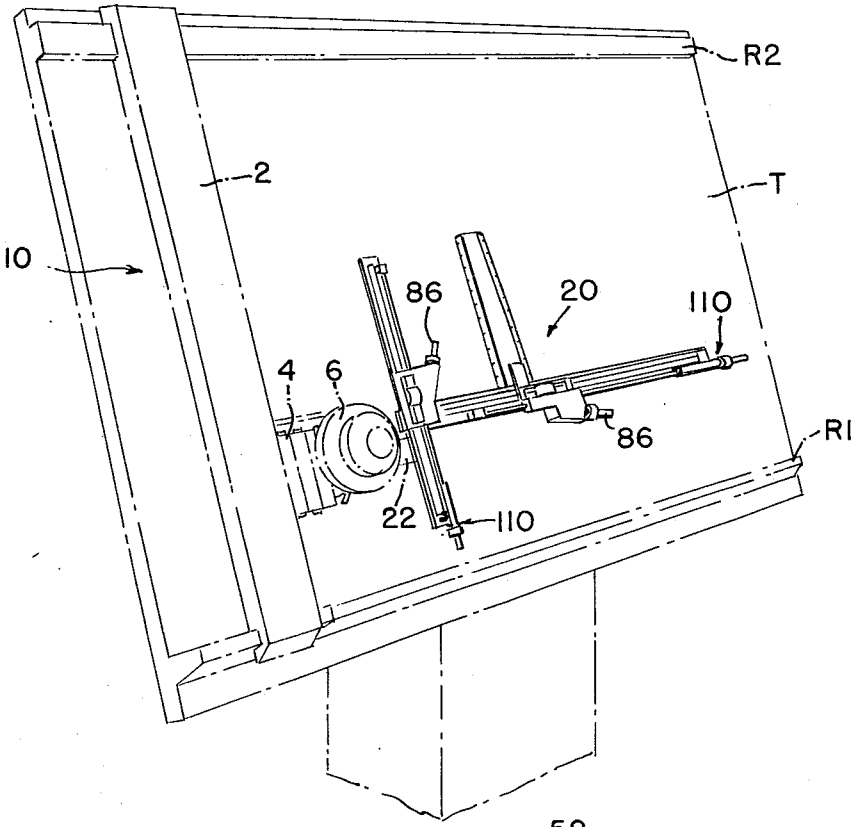
FIG. 1 is a isometric view of a drafting table with one embodiment of the drafting machine of this invention mounted thereon.
Figure 2:
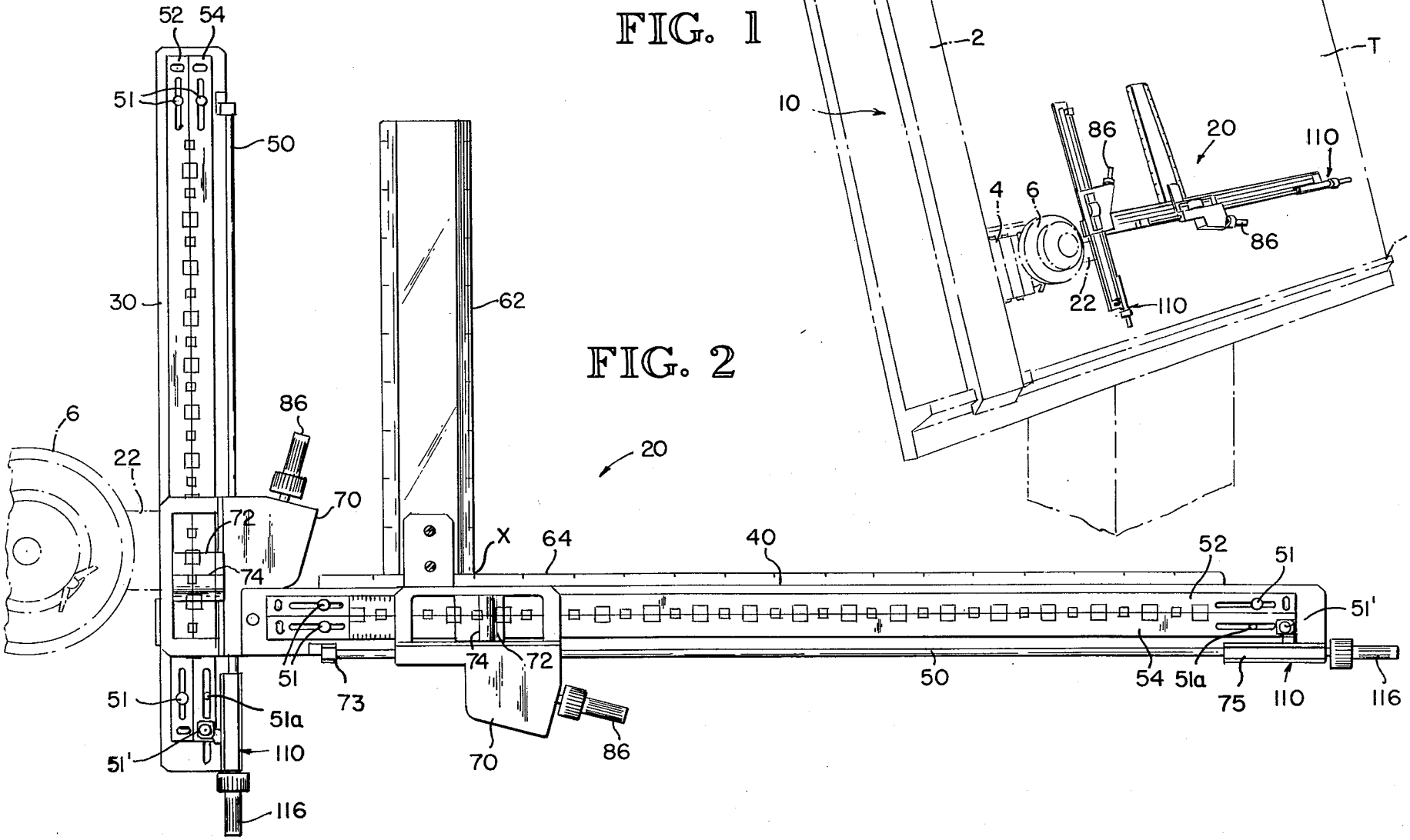
FIG. 2 is a top plan view of a preferred embodiment of the drafting machine of this invention cut away at the protractor head to illustrate the straight edge assembly.
Figures 3, 4, 5, 6, 7:
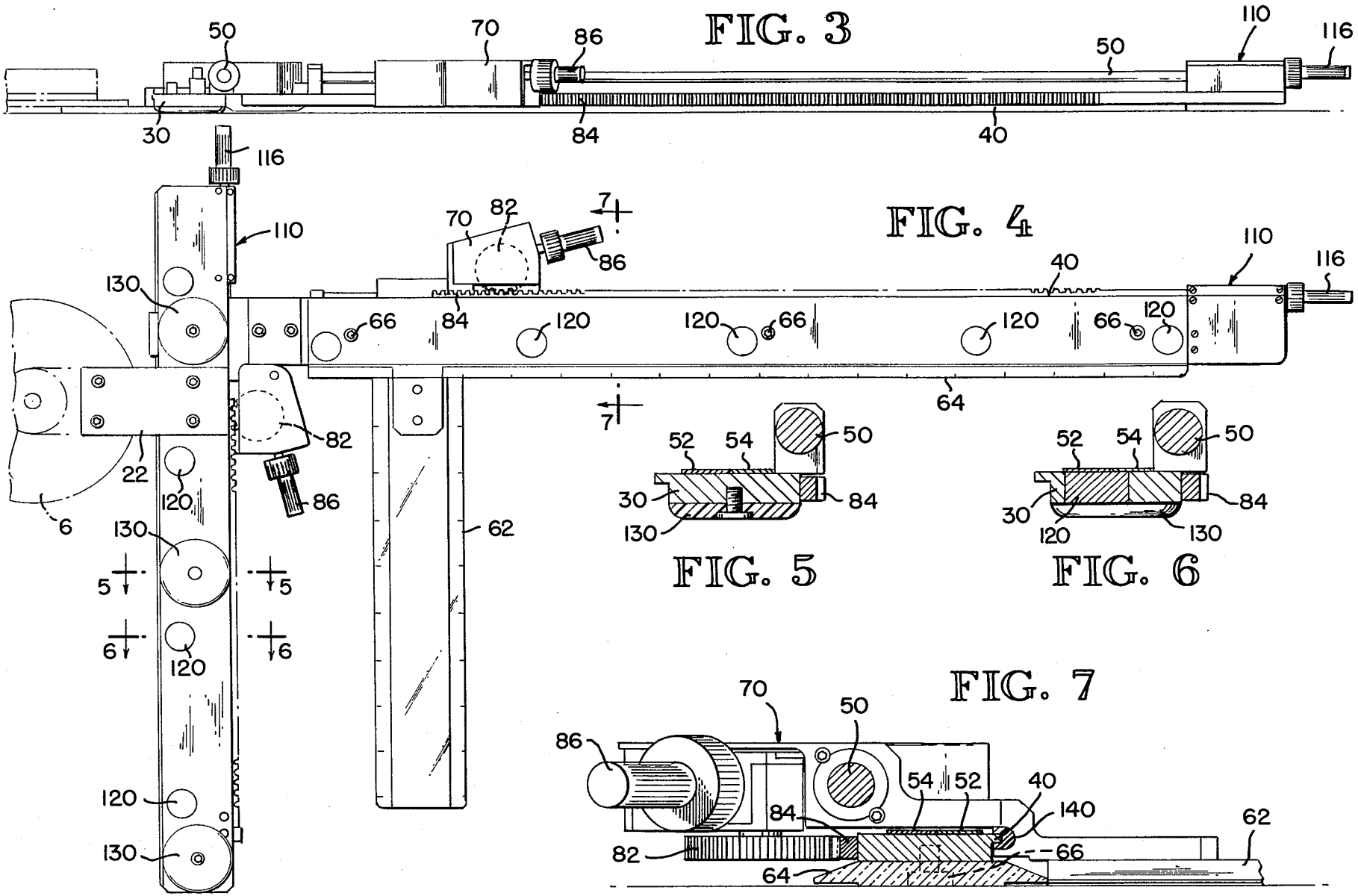
FIG. 3 is a rear elevation view illustrating a drafting machine embodying the present invention.
FIG. 4 is a bottom plan view of a preferred embodiment of the drafting machine of this invention.
FIG. 5 is a cross-sectional view taken through line 5—5 of FIG. 4.
FIG. 6 is a cross-sectional view taken through line 6—6 of FIG. 4.
FIG. 7 is a cross-sectional view taken (cover removed) through line 7—7 of FIG. 4.

A preferred embodiment of the drafting machine of this invention is illustrated in FIG. 1. The drafting machine 10 is mounted on a drafting table T in a conventional manner. A vertical arm 2 is slidably mounted on table runners $R_1$, $R_2$ for horizontal movement and a relatively short horizontal arm 4 extends perpendicularly from the vertical arm 2 to support a protractor head 6 and straight edge assembly 20. The horizontal arm 4 is slidably mounted on the vertical arm 2 for vertical movement of the protractor head 6 and straight edge assembly 20. The straight edge assembly 20 includes a short mounting arm 22 which is rotatably mounted to the protractor head 6 at its inner end and is adjustably secured to the remainder of the straight edge assembly 20 at its outer end, as best seen in FIG. 4. The protractor head 6 is adjustable to either restrict or permit rotation of the mounting arm 22, as desired, and can be locked in selected position relative to the drafting table T. The straight edge assembly 20 includes a vertical mounting bar 30 which is adjustably mounted on the outer end of the mounting arm 22 and a horizontal mounting bar 40 which is slidably attached to the vertical mounting bar 30 in an adjustably perpendicular arrangement, as seen in FIG. 2. Housings 70 are slidably mounted on guide rods 50 and extend perpendicularly from respective of the mounting bars 30,40. The horizontal straight edge 64 is mounted on the back side of the horizontal mounting bar 40 and held in place by fasteners 66, as seen in FIGS. 4 and 7. Thus, the slidable housing 70 mounted on the vertical guide rod 50 supports both the horizontal mounting bar 40 and corresponding straight edge 64.

Each mounting bar 30,40 preferably includes a reference scale 52 and an adjustable scale 54 which are removably mounted lengthwise on the top face of the mounting bars 30,40. A viewing window within each slidable housing 70 allows the user of the drafting machine to read the position of the sliding housing 70 (and consequently, the straight edge 62,64) with respect to the scales. A hairline 74 is preferably positioned on a magnifying lens 72 in the viewing window and aligned with the drawing edge of each straight edge 62,64 to facilitate positioning the straight edge at a desired scale reading.

Unlike conventional drafting machines wherein the straight edges usually do not contact one another, the straight edges 62,64 of the drafting machine 10 abut one another at their respective alignment points, as indicated by reference letter X in FIG. 2. By providing abutting surfaces aligned with hairlines 74, the drafting machine 10 enables a draftsperson to quickly and accurately mark points by drawing a small right angle along the abutting surfaces. This feature is especially helpful when plotting graphs using plotting scales, as described below.

The position of each straight edge 62,64 may be varied by using a fine adjustment mechanism 80 or by overriding the fine adjustment mechanism 80 and sliding the housing freely along the measuring scales 52,54.

Figure 8:
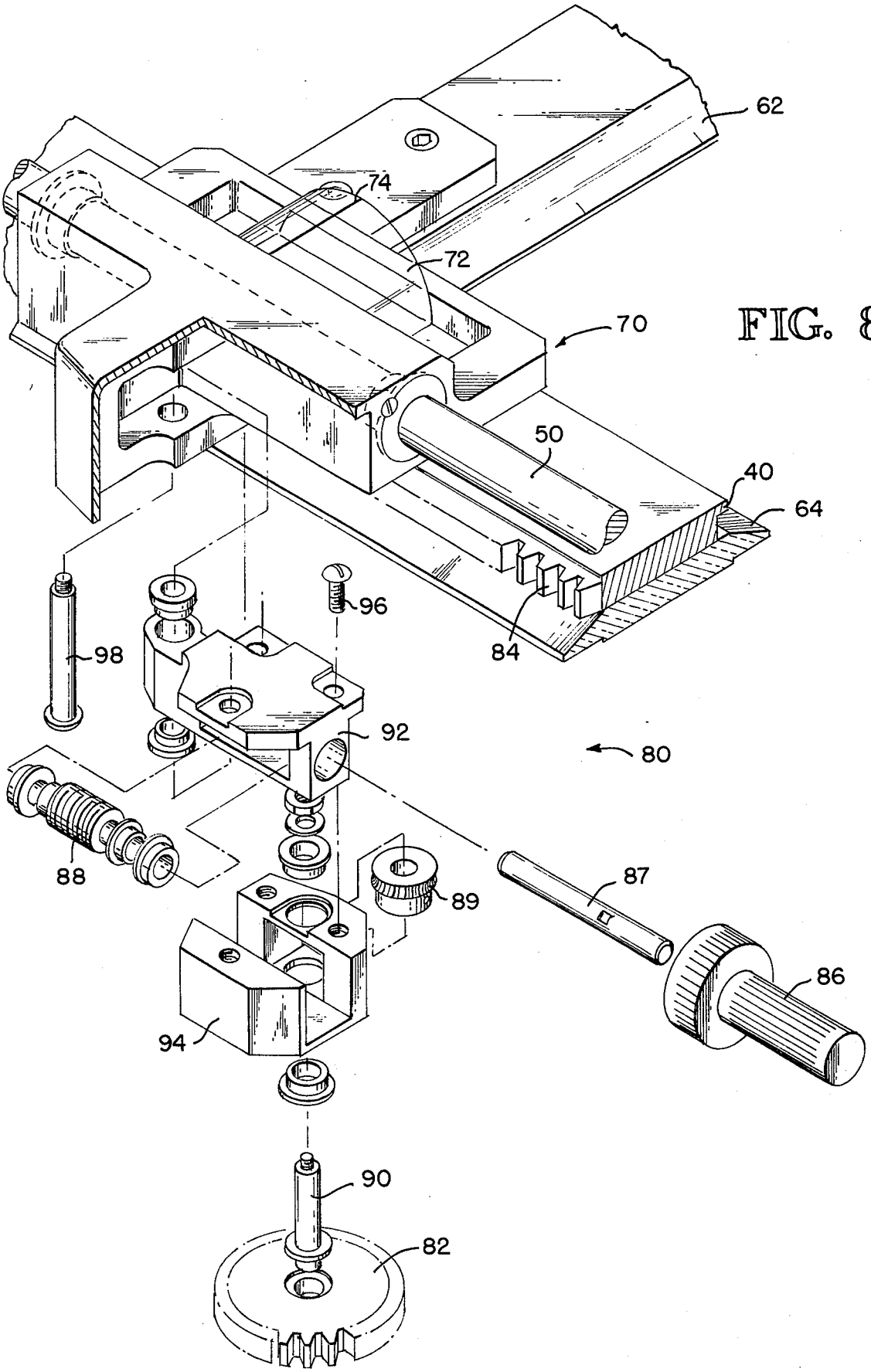
FIG. 8 is an exploded view of the slidable housing.

The fine adjustment mechanism 80 is located within the slidable housing 70. It operates by rotating a spur gear 82 along a rack 84 to move the slidable housing along the guide rod 50. As best seen in FIG. 8, the fine adjustment mechanism 80 includes an adjustment knob 86 which is mounted on a common axle 87 with worm 88. Worm 88 meshes with worm gear 89, which is mounted on a common axle 90 with spur gear 82 to rotatably couple the adjustment knob 86 to the spur gear 82. As illustrated in FIG. 8, a first axle housing 92 and a second axle housing 94 are held together by fasteners 96. The axle housings 92,94 are pivotally mounted within the slidable housing 70 by fastener 98, as seen in FIGS. 8, 9 and 10.

To operate the fine adjustment mechanism 80, the user of the drafting machine 10 need only rotate the adjustment knob 86. As seen in FIG. 9, spring 100 biases the pivotally mounted fine adjustment mechanism 80 into contact with rack 84. The rotation of the adjustment knob 86 will cause the spur gear 82 to rotate, thereby moving the slidable housing 70 along the measuring scales 52,54. Guide rods 50, which extend lengthwise above the measuring bars 30,40, pass through a passageway in the slidable housing 70 as the slidable housing 70 moves along the measuring scales 52,54. These guide rods are supported at their ends on brackets 73,75. Each slidable housing 70 slidably engages its corresponding mounting bar 30,40, as shown in FIG. 7 to prevent rotation of the housing. A synthetic coating layer 140 is preferably mounted on the surfaces of the slidable housing 70, which directly engage the mounting bar 30,40 to reduce friction during sliding. The synthetic layer is preferably comprised of fluorene-containing resin material, such as Teflon, although other similar low-friction coatings could be used, and substitution of such materials will be obvious to those of ordinary skill in the art. It is preferred to provide ball bearing-type precision linear bearing units as bushings in the housings for rolling engagement with the guide rods 50 to eliminate any play as the housings move along the rods.

An alternate means for moving the slidable housing 70 and attached straight edges 62,64 along the measuring scales 52,54 is available by overriding the fine adjustment mechanism 80. The fine adjustment mechanism 80 may be pivoted away from the rack 84 by pushing the adjustment knob 86 away from the rack 84 and compressing spring 100, as shown in FIG. 10. A slot 102 positioned in the adjustment knob 86 of the fine adjustment mechanism 80 (see FIG. 12) receives peg 104 to isolate spur gear 82 from rack 84, thereby overriding the fine adjustment mechanism. Once the fine adjustment mechanism 80 has been overridden, the user of the drafting machine 10 can slide the straight edges 62,64 along the measuring scales 52,54 by merely pushing the slidable housing 70 in the desired direction.

In addition to providing a mechanism for adjusting the position of the straight edges 62,64 with respect to the mounting bars 30,40, the drafting machine 10 also includes a scale adjustment mechanism 110 partially housed in the bracket 75. In this regard, the scales 52,54 are removably mounted on the mounting bars 30,40 by threaded dowels **51*a* projecting through longitudinal slots 53 in the scales. Cap nuts 51 are provided for the dowels 51*a* of the scales 52 for clamping them in selected longitudinal positions. The scales 52,54 also have transverse slots 55 at their ends. Only the transverse slots 55 at the ends of the scales 54 located adjacent the brackets 75 are used, as will now be described. The scale adjusting mechanism 110 includes a traveling nut 114 which is movable lengthwise of a slide chamber in the bracket 74. This chamber has a slot 75*a* therealong for passage of an extension arm 115 connecting the nut 114 with a traveler 117. This traveler has a threaded bore 119 (FIG. 13) extending to a counter-bore 120 facing the scale 54. A screw 121 with a head 51' is received in the bore 119 and has a non-threaded extension 121' projecting through the transverse slot 55 into a longitudinal groove 57 in the respective underlying member 30,40. The extension 121' is preferably circumferentially grooved to receive a keeper 122 in the form of a snap-ring. The location of the adjustable scales 54 with respect to the reference scales 52 may be varied by rotating a respective scale adjustment knob 116, which is coupled to the traveling nut 114 by a jack screw 118 retained at its ends. The scale adjustment mechanism 110 allows the user of the drafting machine 10 to position the adjustable scales 54 so that an integer reading on the adjustable scales 54 is aligned with a known point on reference scale 52**. This alignment capability permits quick and accurate measurement of distances from that known point.

To remove an adjusting scale 54, the captivating screw 121 is backed off and then the scale is shifted endwise from beneath the traveler 117. The scale is flexible enough to then be bent outwardly and moved endwise over the head 51' of the captivated screw 121. "Plotting scales" may be installed as reference scales 52 to facilitate plotting graphs with the drafting machine 10. Plotting scales are scales which, rather than ascending numerically from left to right as do conventional scales, have a zero point in the center with a negative scale to the left of center and a positive scale to the right of center. When plotting scales are installed on each mounting bar 30,40, the straight edges 62,64 can be easily moved around the resulting four quadrants for quickly plotting graphs.

The reference scales 52 and adjustable scales 54 are preferably fabricated of metallic material so that magnets 120 mounted within the mounting bars 30,40 will hold the scales 52,54 flat against the mounting bars 30,40 during use. The vertical mounting bar includes circular spacers 130 mounted on the back side thereof, as shown in FIG. 5. The thickness of the circular spacers 130 is approximately equal to the thickness of the straight edge 64 under the horizontal mounting bar 40 to ensure that both mounting bars 30,40 will rest approximately the same distance from the surface of the drafting table T.

It will be appreciated that the sight glass can be a magnifying lens and that the sight glass can be elongated and provided with a vernier scale for even more precise measurements.

It will be obvious to those of ordinary skill in the art that modifications to the drafting machine 10 described herein could be made without departing from the spirit of the invention. For example, instead of being used with a lockable type of movable arm assembly as shown, the drafting machine of this invention will function equally well if it is mounted on a relatively horizontal drafting table by a parallel motion linkage arm assembly which is not adapted to be locked. It is not intended that the drafting machine of this invention be limited to the embodiment disclosed herein, but rather that it include all embodiments within the spirit of the invention and equivalents thereof.

I claim:

1. A drafting machine for use with a drafting table having a drawing surface, which comprises:

a protractor head adapted to be movably mounted on a drafting table such as to permit horizontal and vertical movement of the protractor head along the drawing surface of the drafting table;

an elongated first mounting means rotatably mounted on the protractor head and having an elongated first reference scale, the longitudinal axis of the first reference scale being parallel to the longitudinal axis of the first mounting bar;

an elongated second mounting means slidably mounted on the first mounting means with the longitudinal axis of the second mounting means being perpendicular to the longitudinal axis of the first mounting means, the second mounting means having an elongated second reference scale, the longitudinal axis of the second reference scale being parallel to the longitudinal axis of the second mounting means;

first and second elongated straight edges, said first straight edge being slidably mounted with respect to the second mounting means and the second straight edge, the longitudinal axis of the first straight edge being parallel to the first mounting means and being perpendicular to the longitudinal axis of the second mounting means and to the second straight edge, the first straight edge being alignable with the reference scale of the second mounting means; and said second straight edge being mounted on the second mounting means so as to be slidably mounted with respect to the first mounting means, the longitudinal axis of the second straight edge being perpendicular to the longitudinal axis of the first mounting means, the second straight edge being alignable with the first reference scale.

2. The drafting machine of claim 1, including:

an elongated longitudinally adjustable scale mounted on one of said mounting means in parallel adjacent relation to the respective reference scale.

3. The drafting machine of claim 1, including:

elongated third and fourth reference scales mounted on said first and second mounting means, respectively, in parallel adjacent relation to the first and second reference scales, respectively.

4. The drafting machine of claim 3 in which said first and third reference scales are longitudinally adjustable relative to the first mounting means and to one another, and in which said second and fourth reference scales are longitudinally adjustable relative to the second mounting means and to one another.

5. The drafting machine of claim 1 in which said first and second reference scales are removable.

6. The drafting machine of claim 1 in which said first and second reference scales are longitudinally adjustable relative to the first and second mounting means, respectively.

7. The drafting machine of claim 1 in which the second straight edge is slidably mounted with respect to the first mounting means by a first slidable housing which is slidably mounted on the first mounting means and is connected to the second mounting means.

8. The drafting machine of claim 7 in which the first straight edge is slidably mounted with respect to the second mounting means and the second straight edge by a second slidable housing which is slidably mounted on the second mounting means.

9. The drafting machine of claim 1 in which first and second slidable housing are slidably mounted on the first and second mounting means, respectively, said second housing carrying the first straight edge, and said first slidable housing carrying the second straight edge, the second mounting means, and the second slidable housing.

10. The drafting machine of claim 9 in which said first and second mounting means include respective first and second guide rods on which said first and second housings are respectively slidably mounted.

11. The drafting machine of claim 9 in which said first and second housings have sight glasses overlying the first and second reference scales, respectively.

12. The drafting machine of claim 1 in which first and second adjustment means are slidably mounted on said first and second mounting means, respectively, for independently adjusting the second straight edge location relative to the first reference scale and for independently adjusting the first straight edge relative to the second reference scale.

13. The drafting machine of claim 12 in which each adjustment means includes a rack fixed on the respective mounting means, a pinion meshing with the rack, a worm gear driving the pinion, and a worm meshing with the worm gear, means for selectively swinging the pinion, worm gear and worm as a unit away from meshing engagement of the pinion with the rack, and means biasing said unit such that the pinion is normally meshing with the rack.

14. In a drafting machine:

first and second straight edge providing means;

mounting means slidably mounting said first straight edge means to move along said second straight edge providing means in perpendicular relation thereto;

a rack on the second straight edge providing means;

a pinion normally meshing with the rack;

a worn gear driving the pinion;

a worm meshing with the worn gear;

means carried by said mounting means for selectively swinging the pinion, worm gear, and worm as a unit out of mesh with the rack; and means biasing said unit into mesh with the rack.

15. In a drafting machine according to claim 14:

a reference scale on said second straight edge providing means;

a longitudinally adjustable scale on said second straight edge providing means extending in parallel relation to the reference scale; and a sight glass on said mounting means arranged for viewing said scales.

16. In a drafting machine according to claim 15:

spaced longitudinal slots and an opening through said adjustable scale;

guide means extending from said second straight edge means into said slots; and adjustable traveling means carried by said second straight edge means and interfitting with said opening for adjusting said adjustment scale.

17. In a drafting machine:
first and second straight edge providing means;
a guide rod mounted on said second straight edge providing means and extending in parallel spaced relation thereto;
a housing sleeved on said guide rod and having sliding engagement with said second straight edge providing means;
means mounting said first straight edge providing means on said housing such that said first and second straight edge providing means are always perpendicular to one another as said housing is moved along said guide rod;
scale means mounted on said second straight edge providing means; and
a sight glass mounted in said housing and overlying said scale means for determining the position of said first straight edge providing means relative to said scale means.

18. In a drafting machine according to claim 17, said scale means comprising a reference scale and an adjustable scale positioned side-by-side in parallel relation to said guide rod.

19. In a drafting machine according to claim 17:
a rack extending along said second straight edge providing means in parallel spaced relation to said guide rod;
a gear unit swing-mounted on said housing to move into and out of mesh with said rack for varying the location of said first and second straight edge providing means relative to one another; and
spring means biasing said gear unit toward said rack.

20. In a drafting machine according to claim 17, said gear unit comprising a pinion normally meshing with the rack, a worm gear driving the pinion, and a worm meshing with the worm gear and having a turning knob exposed externally of said housing.

21. In a drafting machine according to claim 17, said guide rod being adjacent one longitudinal side edge of said second straight edge providing means and said sliding engagement being along the opposite longitudinal side edge thereof.

22. In a drafting machine according to claim 21, a rack mounted at said one longitudinal side edge, and a gear unit swing-mounted on said housing to move into and out of operative engagement with said rack for finely adjusting the position of said first straight edge providing means relative to the second straight edge providing means when said gear unit is operated while in engagement with said rack, and permitting said first straight edge providing means to be freely moved along said guide rod when the gear unit is out of engagement with the rack.

23. In a drafting machine:
straight edge providing means having a longitudinal slot;
an adjustable scale with an opening therethrough registering with said slot; a jack screw mounted on said straight edge providing means and extending parallel to said scale and slot;
traveler nut means on said jack screw and extending over said opening in the scale; and
a screw threaded into said traveleer nut means and projecting through said opening into said slot.

24. In a drafting machine according to claim 22:
a reference scale extending along one side edge of the adjustable scale and having a pair of longitudinally spaced longitudinal slots; and
locking means extending through said longitudinal slots into said straight edge providing means.

25. In comination:
an elongated unit;
a slide unit on the elongated unit;
a rack along the elongated unit;
an adjustment and locking assembly on the slide unit, said assembly including a housing swing-mounted on the slide unit, a pinion journaled in the housing and meshing with the rack for fine adjustment of the slide unit relative to the elongated unit and for locking the slide unit relative to the rack when the pinion is not being turned for said fine adjustment;
a worm gear journaled in the housing for driving the pinion, a worm journaled in the housing and meshing with the worm gear, a handle extension on the worm for manually turning it to responsively provide said fine adjustment and for swinging said assembly into an inoperative position away from meshing engagement of the pinion with the rack so that the slide unit is free to slide on the elongated unit; and
means biasing said assembly such that the pinion is normally meshing with the rack.

26. The combination of claim 25 in which locking means are provided on said handle extension and housing for selectively holding said assembly in said inoperative position.

* * * * *